US008381375B2

(12) United States Patent
Dos Santos et al.

(10) Patent No.: US 8,381,375 B2
(45) Date of Patent: Feb. 26, 2013

(54) METHOD FOR CONTROLLING THE LOCAL CHARACTERISTICS OF A NON-WOVEN TEXTILE AND RELATED INSTALLATION

(75) Inventors: Cathia Dos Santos, Domene (FR); Michel Colotte, Neuville-en-Ferrain (FR); Jean-Louis Dupont, Tourcoing (FR); François Louis, La Saussaye (FR)

(73) Assignee: Asselin-Thibeau, Tourcoing (FR)

( * ) Notice: Subject to any disclaimer, the term of this patent is extended or adjusted under 35 U.S.C. 154(b) by 744 days.

(21) Appl. No.: 12/399,311

(22) Filed: Mar. 6, 2009

(65) Prior Publication Data

US 2009/0217498 A1 Sep. 3, 2009

(51) Int. Cl.
*D04H 5/08* (2012.01)

(52) U.S. Cl. ..... 28/102; 28/103; 28/104; 28/112; 19/163; 19/296; 19/300

(58) Field of Classification Search ..... 28/101, 28/102, 104, 107, 112, 116, 122, 165; 19/163, 19/300, 296, 65 A, 98, 161.1, 99, 106 R; 156/148, 183, 324, 64
See application file for complete search history.

(56) References Cited

U.S. PATENT DOCUMENTS

| | | | | |
|---|---|---|---|---|
| 314,369 | A * | 3/1885 | Dolge | 19/161.1 |
| 3,877,628 | A | 4/1975 | Asselin et al. | |
| 4,107,822 | A * | 8/1978 | Brown | 19/163 |
| 4,271,565 | A * | 6/1981 | Grunder | 19/240 |
| 4,287,246 | A * | 9/1981 | Thornton et al. | 428/113 |
| 4,366,111 | A * | 12/1982 | Dinius et al. | 264/518 |
| 4,375,447 | A * | 3/1983 | Chung | 264/518 |
| 4,944,502 | A * | 7/1990 | Platzer et al. | 270/30.12 |
| 5,060,347 | A | 10/1991 | Beckers | |
| 5,301,399 | A * | 4/1994 | Erhardt | 28/102 |
| 5,325,571 | A * | 7/1994 | Bolliand | 28/112 |
| 5,341,543 | A * | 8/1994 | Jean et al. | 19/163 |
| 6,195,844 | B1 | 3/2001 | Jourde et al. | |
| 6,434,795 | B1 | 8/2002 | Jourde et al. | |
| 6,662,407 | B2 * | 12/2003 | Bernhardt et al. | 19/161.1 |
| 7,581,294 | B2 * | 9/2009 | Dilo | 28/101 |

FOREIGN PATENT DOCUMENTS

| | | |
|---|---|---|
| EP | 0 371 948 | 6/1990 |
| EP | 1 036 227 | 9/2000 |
| EP | 1 057 906 | 12/2000 |
| FR | 2 234 395 | 1/1975 |

(Continued)

OTHER PUBLICATIONS

Search Report, dated Jul. 26, 2007 and issued in corresponding French Patent Application No. 688191.

*Primary Examiner* — Amy Vanatta
(74) *Attorney, Agent, or Firm* — Young & Thompson

(57) ABSTRACT

A crosslapper receives a card web and folds it into a lap intended to be needle-punched or consolidated by other ways. The web includes zones which are more condensed, having a spectrum of orientation of fibers with a component parallel to the width of the web, alternating with less condensed zones having a longitudinal unidirectional spectrum of orientations. The zones which are less condensed are used to form the edge zones of the lap. The result is that the lap has different respective spectra of orientation which pre-compensate for the unwanted changes produced by the needle-punching or other consolidation which follows. A needle-punched lap is obtained having a uniform MD/CD ratio (relationship between longitudinal and respectively transverse tensile strengths) or having a sought profile of the MD/CD ratio across the width of the lap.

31 Claims, 4 Drawing Sheets

FOREIGN PATENT DOCUMENTS

| | | |
|---|---|---|
| FR | 2 770 855 | 5/1999 |
| FR | 2 794 475 | 12/2000 |
| FR | 2 828 696 | 2/2003 |
| GB | 1 099 594 | 1/1968 |
| WO | 00/73547 | 12/2000 |
| WO | 02/101130 | 12/2002 |

* cited by examiner

METHOD FOR CONTROLLING THE LOCAL CHARACTERISTICS OF A NON-WOVEN TEXTILE AND RELATED INSTALLATION

The present invention relates to a method for producing a non-woven textile locally exhibiting specified characteristics, in particular in terms of mechanical strength. The invention also relates to an installation for the implementation of this method.

TECHNICAL FIELD

It is known to produce a continuous lap in a crosslapper fed with one or more webs produced in a carding machine.

In the crosslapper, the web is folded alternately in one direction and then the other on a delivery belt, thus giving a lap composed of overlapping web segments alternately inclined in one direction and then in the other relative to the widthwise direction of the lap. The folds between successive segments are aligned along the lateral edges of the lap produced. The fibre lap obtained is generally intended for a subsequent consolidation treatment, for example, by needle punching, coating and/or etc. to obtain the sought non-woven textile endowed with a degree of coherence and having a certain number of mechanical strength characteristics, in particular as regards tensile strength.

Patent FR-A-2 234 395 teaches the speed ratios which must be observed in the crosslapper in order to control the surface weight of the lap at all points of its width.

The needle loom consolidates the lap by entangling the fibres with one another and interpenetration of the various layers. Boards fitted with a very large number of needles perpendicular to the plane of the lap regularly strike the fibre lap passing through the needle loom. Fibres from the various layers are thus drawn from one layer to another, resulting in a felting effect which gives the lap a degree of strength.

During its consolidation, the distribution of the fibres in the lap changes. Due to the interpenetration and entangling of the fibres, the lap is compacted mainly through a reduction in its thickness. However, a slight reduction in the width of the lap is also observed. Moreover, the surface weight of the lap is frequently affected by the consolidation process, and is typically increased at the edges of the lap.

A disadvantage of these changes in the lap is that the total quantity of fibres has to be increased in order that the lightest point of the consolidated lap satisfies the surface weight criteria requested by the purchaser. The heaviest zones of the lap, in other words the edges, therefore represent a needless consumption of fibres which is unprofitable at the time of sale, as well as a needless increase in the total weight of the lap, with the resulting subsequent disadvantages for example during handling or use.

Hitherto, it has been sought to overcome this drawback by producing a lap that has, before the needle-punching, a greater surface weight at its centre than at its edges.

Thus patent EP-B-0 371 948 describes a method intended to pre-compensate for the defects occurring during subsequent consolidation, in particular the needle-punching, by locally varying the weight of the web introduced into the crosslapper. This is achieved by automatically controlling the speed of a doffer of the carding machine relative to the speed of the cylinder of the carding machine. The faster the doffer turns relative to the cylinder, the lighter is the web formed by the doffer. The lightest zones in the web are those intended to form the edges of the lap.

Patent EP-A-1 036 227 describes a method for producing a lap whose surface weight has a specified profile over the width of the lap, again by locally varying the surface weight of the web introduced into the crosslapper. This is achieved by varying at the carding machine a dynamic control which exerts an influence upon the weight of the web, for example by modifying the distance between the doffer and the carding cylinder in order to alter the quantity of fibres removed by the doffer, or by "condensing" the fibres in a variable manner downstream of the doffer. It is said that a card web is 'condensed' when, in particular in a device called a "condenser", the web is compressed longitudinally in order to increase its surface weight while simultaneously transforming the web from an initial state where the fibres are longitudinally orientated into a condensed state where the fibres exhibit a less unidirectional distribution of orientations, in other words, with at least some of its fibres having, along at least part of their length, an orientation forming an angle with the longitudinal direction of the web.

According to WO 00/73547 A1, the dynamic weight control means form part of a control loop comprising means for detecting the surface weight profile of the consolidated lap. Typically, the speed of rotation of the card doffer is re-adjusted according to the difference between the result of this detection and a set value. The detection means simultaneously detects the width of the consolidated lap and the adjustment corrects the length of travel of the lapper carriage of the crosslapper according to the difference between the detected width and a nominal set width value in order to give the lap an actual width as close as possible to the desired nominal width. In an improved version, the longitudinal profile of the surface weight of the lap is also adjusted. The consolidated lap obtained thus has a very uniform width and surface weight that are very close to the respective targeted nominal values. EP 1 057 906 B1 describes another dynamic method for controlling the surface weight profile of a lap.

Purchasers are increasingly taking account of certain criteria, in particular tensile strength values, measured in particular along different directions of the non-woven textile, for example in the widthwise direction of the non-woven textile ("Cross Direction") and in the longitudinal direction of the non-woven textile ("Machine Direction").

For example, a criterion commonly required of non-woven textiles, in particular in the field of geotextiles, is expressed in the form of the following variables:

- the tensile breaking strength in the longitudinal direction of the textile (or the lap) called "Machine Direction";
- tensile breaking strength in the in the widthwise direction of the textile (or the lap), called "Cross Direction";
- the relationship between these two strength values, referred to as MD/CD, in other words the "machine Direction" strength divided by the "Cross Direction" strength.

When the mechanical characteristics obtained in the consolidated lap do not match the requirements, it is common practice to strengthen the entire lap by locally or generally increasing the quantity of fibres.

In order to achieve one of these characteristics, more fibres frequently have to be used than is required by the other characteristic, which runs counter to an optimization of the quantity of fibres used.

For example, if the two strengths MD and CD must have the same minimum value, in order to optimize fibre consumption while ensuring adequate strength in both directions, the MD/CD ratio will have to be as near as possible to the value 1:1

Moreover, it is frequently observed that the MD/CD ratio has a quite different value at the edges of the lap compared with at the central part. Even if the surface weight of the non-woven textile is uniform over its entire width, because, in particular, of the weight compensations carried out according to the prior art, the MD/CD ratio of a non-woven textile according to the prior art is generally not uniform, since the distribution of orientation of the fibres is not the same at all points of the width of the non-woven textile. For example, a consolidation by needle-punching tends to promote the transverse orientation of the fibres close to the centre of the lap rather than close to the edges of the lap.

If the distribution of the recorded strength values does not match the required characteristics, and in particular if the required values are the same across the entire width of the lap, the lap will then need to be strengthened across its entire width, in order that the smallest value is sufficient.

Furthermore, it may be useful to be able to choose a distribution of these strength values within the width of the lap, in according to a non-uniform profile that satisfies the requirements of a particular specification. This may involve for example obtaining a profile having one or more specifically higher or lower strength values in one or more zones of such a profile.

An object of the invention is therefore to enable a non-woven textile to be obtained that has at least one of the following characteristics in its width:

- one or more local mechanical characteristics controlled in one or more regions;
- a uniform distribution of its longitudinal (MD strength) or transverse (CD strength) strength values or of the relationship between these values;
- a non-uniform distribution of these values, distributed according to a specific profile;
- a combination of such distributions of strength values with a distribution of surface weight distributed according to a specific profile.

The invention also seeks to optimize the quantity of fibres necessary to obtain a non-woven textile all of whose parts have certain minimum characteristics, as well as to optimize the weight or the volume of such a non-woven textile.

To this end, the invention proposes a method for the production of non-woven textile strips, characterized in that, by means of at least one dynamic control, influence is exerted in a targeted manner on the distribution of orientation of the fibres according to the position of said fibres in the widthwise direction of the strip.

By "dynamic control" is meant an adjustment that is reviewed and, if necessary, continuously or repeatedly modified (for example, at regular time intervals) while the installation is operating during production.

The invention is based on the idea of differentiating between the orientations of fibres according to the location of the fibres along the width of the lap, either to obtain different mechanical characteristics in different zones of the width of the lap, or to pre-compensate for the uniformity defects introduced into the mechanical characteristics of the lap during subsequent stages of the production process, in particular during the consolidation and, more particularly, during needle punching. In the case of pre-compensation, knowing that needle punching tends to "longitudinalize" the fibres close to the edges, the invention may be used in order, before the needle punching, to give the fibres close to the edges of the lap a distribution of orientations that promotes transverse orientation in the fibres more than for the fibres forming the central zone of the lap.

In certain cases, for example, for textiles intended to be easily cut, separated or torn, the desired adjustment may aim to provide one or more zones of reduced strength, or a sufficiently low strength at all points of the textiles.

The relevant mechanical characteristics, in particular in the field of geotextiles, comprise tensile strength characteristics in the plane of the textile, for example the elongation before break and especially the breaking strength. For a given category of textile, these characteristics must have an adequate value in all the regions of the textile, and in particular, over its entire width. In the case of characteristics such as breaking strength, this adequate value will generally correspond to a minimum value, and this description will concentrate essentially on this type of characteristic. However, for other characteristics, such as elongations, this adequate value may correspond, in fact, to a maximum value, without departing from the scope of the invention.

Within the framework of the present invention, the concept of "distribution of orientations" is used. This concept takes account of the different orientations present in a given zone, and the greater or lesser abundance of each orientation in this zone. A distribution may be illustrated by a closed curve having a centre. The distance between each point on the curve and the centre indicates the percentage of fibres which have the orientation indicated by the vector running from the centre to this point. In the simplest case of a non-condensed carded web, the fibres are typically all parallel to the length of the web (the curve representing the distribution of orientations is completely flattened to become a simple segment). If this web is then lapped in successive segments which overlap in a zigzag, as will be described below, the distribution in the lap obtained is preponderantly parallel to the width of the lap but has a dimension in the "Machine Direction" resulting from the obliquity of the web segments relative to the width of the lap. This could then be termed a bi-directional distribution represented by a curve being in the shape of an "X" flattened to a greater or lesser degree.

In the more complex case of a condensed card web, the initially longitudinal fibres of the non-condensed web have been folded back onto themselves and/or 'transversalized' by the condensation, so that the distribution of orientation is no longer unidirectional but omnidirectional, represented by an oval.

In a first or preferred embodiment, influence is exerted on the orientation of the fibres in the web. Such a dynamic control of the web is undertaken before the folding of the web back onto itself to form the lap. Influence can for example be exerted on the distribution of orientation of the fibres in the web within the assembly forming the carding machine, but also during transport to the crosslapper, or into the entrance of the crosslapper. The distribution of orientation of the fibres in the successive zones of the length of the web is adjusted according to the position that these zones will adopt along the width of the lap.

In particular, the orientation of the fibres can be influenced by an adjustable condensation of the web. Such a condensation of the web can itself be carried out using several methods that can be used at the user's discretion, or even combined with each other.

Typically, the dynamically controlled condensation according to the invention is carried out at least in part by varying, relative to one another, the speeds of at least two rotating components of the carding machine involved in the manufacture or transport of the web.

By way of a variant within the framework of this first embodiment of the invention, the condensation is obtained at least in part by an adjustment of a displacement of at least one lapper carriage in a direction substantially transversal to the lap, for example, by giving this carriage a speed different to the one which would ensure that the web leaves the lapper carriage with a run-off speed equal to the displacement speed of the lapper carriage.

If, at a given point of the travel of the lapper carriage, the displacement of the lapper carriage is slower than the run-off of the web through the lapper carriage, the web condenses locally at the exit of the lapper carriage.

If, on the other hand, at a given point on the travel of the lapper carriage, the displacement of the lapper carriage is faster than the run-off speed of the web through the lapper carriage, the web is stretched at the exit of the lapper carriage. This may, for example, locally reduce the effect of a pre-existing condensation of the web and thus modify the local distribution of the orientations of the fibres to bring it closer to a longitudinal unidirectional distribution relative to the web.

And if, at a given point on the travel of the lapper carriage, the displacement speed of the lapper carriage is equal to the run-off speed of the web through the lapper carriage, the web is deposited substantially unchanged on the exit apron of the crosslapper.

In a second embodiment, which can optionally be combined with the first embodiment, influence is exerted on the relationship between the depositing of the web on the exit apron of the crosslapper and the run-off of the exit apron conveying the lap being formed to the exit of the crosslapper.

In this way, the direction in which the web is deposited on the lap, in other words the angle that this direction forms with the axes of the lap, and hence the angle formed by the deposited fibres with the axes of the lap, in particular when the fibres of the web are longitudinal relative to the web, is modified. In particular, the angle of inclination of the web segments in the lap depends on the relationship between the speed of the exit apron and the travelling speed of the lapper carriage. For example, if the speed of the exit apron is reduced not only absolutely but also relative to the speed of the lapper carriage which is itself in the process of reducing when the lapper carriage is close to the end of its travel, the web fibres are deposited with a lesser inclination relative to the width of the lap close to the edges of the lap; which pre-compensates for the defect subsequently introduced by a process of consolidation by needle-punching.

Very advantageously, the invention can be combined with methods known per se for producing a pre-determined surface weights distribution over the width of the lap.

In particular, the degree of condensation of the parts of the web intended to be located at the edge of the lap can be reduced such that the fibres are "more transversal" in the lap close to the edges of the lap before consolidation. In principle, this results in a variation of surface weight close to the edges of the lap. In order to obtain the desired surface weight profile, to this first variation is added a second variation, which is substantially without effect on the distribution of orientation of the fibres, for example a variation of the distance between the doffer and the card cylinder, or a variation in the speed of the doffer and a proportional variation of the components transporting the fibres, which are located downstream of the doffer. In principle, buffer means are provided downstream of the doffer, capable of absorbing the fluctuations in speed in order that the transport speed of the fibres downstream of the collector is not affected by these fluctuations. Such a collector may for example be constituted by a device interposed between the carding machine and the lapper, or also by a buffer positioned at the exit of the crosslapper, or also by the buffer carriage of the crosslapper as described in EP-A-1 036 227.

Preferably, the method according to the invention comprises an adjustment of the dynamic control of the orientation of the fibres according to a detection of at least one variable representative of the distribution of orientation of the fibres in the non-woven textile, preferably the non-woven textile after consolidation.

The measured variable may be the shrinkage experienced by the lap during its consolidation by needle-punching. Such a shrinkage can be interpreted in terms of modification of the distribution of orientation of the fibres in the edge zones of the lap. The dynamic control consists of pre-compensating this modification by one of the orientation means described above, namely the condensation in the carding machine, between the carding machine and the crosslapper, or at the exit of the lapper carriage or also the adjustment of the speed of the exit apron relative to the displacement speed of the lapper carriage.

By way of a variant, the measured value may be obtained from an image of the lap which is analyzed to determine the local distribution of the orientations, or a numerical value or a set of numerical values which represents this distribution, for example, its bi-directional spectrum, as will be defined below.

According to a second feature, the invention relates to an installation for the production of non-woven textiles comprising a carding machine delivering at least one web of fibres, a crosslapper depositing the web in successive transverse segments on an exit apron to form a lap, and a consolidation machine, such as a needle loom, or a device bonding by means of a water jet, or a thermal or chemical bonding device downstream of the exit apron, characterized in that it also comprises orientation means for exerting an influence on the distribution of orientations of the fibres according to their position along the width of the lap.

Further features and advantages of the invention will emerge from the detailed description of embodiments which are in no way limitative and from the accompanying drawings, in which:

FIGS. 1*a* to 1*c* illustrate an example of the variation of the mechanical strength characteristics of a lap according to the prior art, in particular:

FIG. 1*a* represents a cross-section of the lap before and after consolidation according to the prior art, without surface weight compensation;

FIG. 1*b* is similar to FIG. 1*a* but with surface weight compensation;

FIG. 1*c* represents the variation profile of the MD/CD ratio along the width of the of the consolidated lap of FIG. 1*b*, still according to the prior art;

FIG. 2 is a top view of the lap before and after the consolidation treatment, illustrating the method according to the invention;

FIGS. 3*a* and 3*b* represent the distributions of orientation of a non-consolidated lap when the web is non-condensed (FIG. 3*a*) and when the web is condensed (FIG. 3*b*);

FIG. 4 is a side view of the carding machine and the crosslapper, illustrating certain variants of the first embodiment of the invention;

FIG. 5 is a diagrammatic top view of the crosslapper (partially exploded) and its entrances and exits, in an embodiment example implementing the first embodiment according to the invention;

FIG. 6 is a side view of the carding machine in another configuration, illustrating certain variants of the first embodiment of the invention;

Figure 1A:
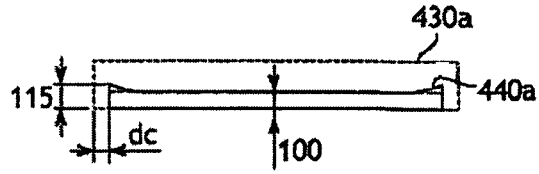

As illustrated in FIG. 1*a*, in the known configurations in which the fibres are arranged in a regular manner to form a lap 430*a* having a substantially rectangular cross section, the consolidation produces a non-woven textile having a profile 440*a* whose edges are clearly heavier, for example with a surface weight of the order of 115 to 120 for the edges if the surface weight at the centre is 100. This increase in the surface weight close to the edges is fed by a lateral shrinkage dc of the consolidated lap relative to the non-consolidated lap.

Figure 1B:
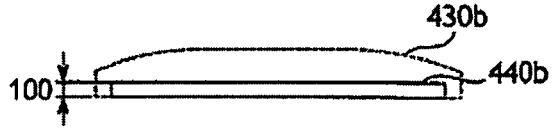

According to the prior art, a compensation of the variations in surface weight is typically obtained by depositing more fibres in the central part of the lap. A domed profile 430*b* is thus produced, as illustrated by dotted lines in FIG. 1*b*. Consolidation then produces a non-woven textile with a substantially uniform surface weight profile 440*b*.

Figure 1C:
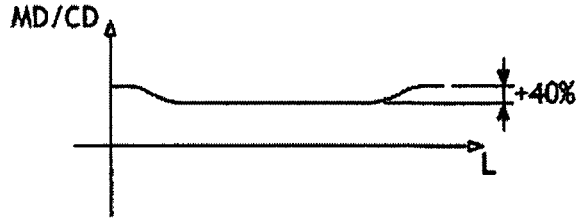

Despite the surface weight uniformity thus obtained, the different breaking strengths obtained in the cross direction CD and in the longitudinal direction MD have a degree of heterogeneity between the edges and the central part of the consolidated lap of the prior art. As illustrated in FIG. 1*c*, the MD/CD ratio between these two breaking strengths may, in certain cases, be 40% greater close to the edges than in the central part. The tensile strength in the longitudinal direction of the lap (MD strength) is higher close to the edges of the lap than in its central part, compared with the tensile strength in the widthwise direction of the lap (CD strength). It is thought that this heterogeneity is due to the fact that the orientation of the fibres close to the edge of the lap is changed by the needle-punching process, jointly with the appearance of the dc shrinkage. According to this theory, the fibres at the edge of the consolidated lap would tend to form on average a wider angle with the width of the lap than the fibres of the central part of the lap.

The lap 430 (FIG. 2) is typically obtained by superimposing several segments of webs S430, overlapping one another. The segments are joined to one another by folds extending along the edges of the lap. The fibres of the lap 430 have different orientations originating in the orientation of the fibres within each of these segments, as well as from the angle A430 at which the segments are deposited on the moving apron carrying the lap. Typically, a lap made from non-condensed web, whose fibres are consequently longitudinal in the web, has a tensile strength which is considerably higher in the cross direction of the lap (CD) than in its longitudinal direction (MD) as the longitudinal direction of the web, and hence the direction of the fibres, are almost transverse in the lap. If the web used is condensed, the distribution of orientation in the lap is more homogeneous, but the transverse or almost transverse orientations remain favoured. Consequently, the CD strength remains higher than the MD strength, even though the relationship between the two is less far from 1:1 than when the web used is not condensed.

Figure 3A:
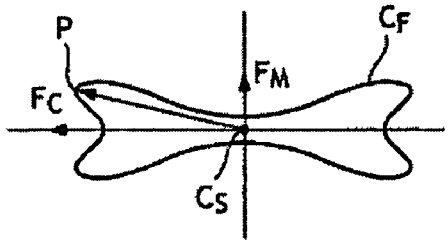
Figure 3B:
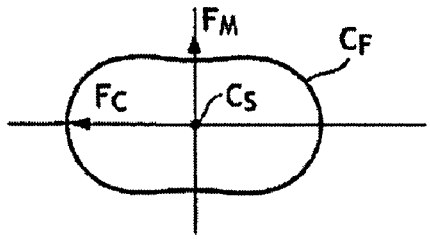

In a given zone of the lap 430, the distribution of orientation of the totality of the fibres present can be represented by a closed curve $C_F$ associated with this zone and having a centre of symmetry Cs. FIG. 3*a* represents an example curve $C_F$ for a lap made from non-condensed web, and FIG. 3*b* an example curve $C_F$ for a lap made of condensed web. Each point P of the curves $C_F$ indicates by its distance from the centre Cs the proportion of fibres having an orientation identical to that of the vector radius $\overrightarrow{CsP}$ connecting the centre Cs to this point P.

Starting from a curve $C_F$ it is possible to establish a representation comprising an arrow FM parallel to the longitudinal direction and an arrow FC parallel to the width of the lap. These two arrows then each have a length proportional to the sum of the longitudinal components and respectively to the sum of the transverse components of the vector radii $\overrightarrow{CsP}$ of a quadrant (chosen arbitrarily from the four possible) of the curve $C_F$. The relationship between the lengths of the arrows FM and FC gives an idea of the MD/CD ratio at the centre Cs. The set formed by the two arrows FM and FC at a given point of a web or lap will be called "bidirectional spectrum of orientations".

Figure 2:
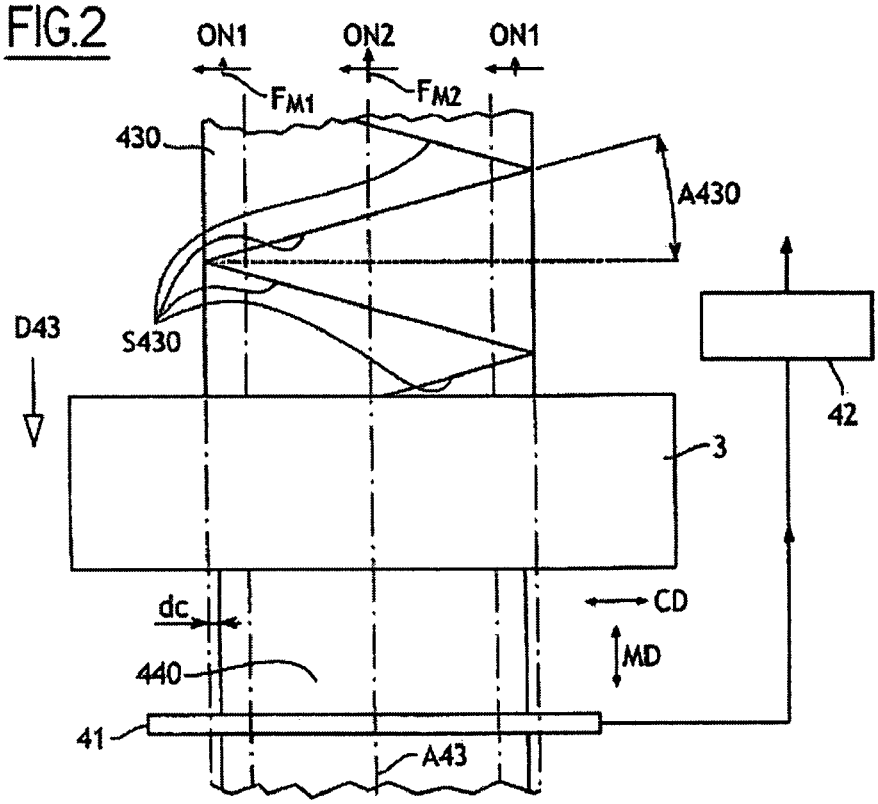

In the example represented in FIG. 2, influence has been exerted on the orientation of the fibres in the lap 430 so as to obtain in the not yet consolidated central part of the lap an orientation spectrum ON2 which is different from the orientation spectrum ON1 in the parts of the lap close to its edges.

Compared with the prior art illustrated in FIG. 1*c*, it will frequently be sought to produce for the lap before needle-punching, an orientation spectrum ON2 at the centre of the lap 430 in which the component $FM_2$ parallel to the longitudinal axis A43 of displacement of this lap is greater than the corresponding component $FM_1$ of the orientation spectrum ON1 close to the edges, in order to pre-compensate the variations in the ratio MD/CD observed in the prior art after needle-punching, and to obtain after needle-punching a spectrum of orientations which is substantially the same at all points of the width of the consolidated lap.

Influence is exerted on the orientation of the fibres in a determined part of the lap 430 by a dynamic control operated upstream of the consolidation treatment in the needle loom 3. More particularly, in this example, the control affects each region of the length of the web according to the position that this region of the length of the web will adopt in the lap.

The fibres of the zones of the web that are intended to adopt a position at the edges of the lap are given an orientation spectrum having a stronger longitudinal preponderance (relative to the web) than are the fibres of the web intended to adopt a position in the central zone of the lap.

A first embodiment will now be described, with reference more particularly to FIGS. 4 to 6.

Figure 4:
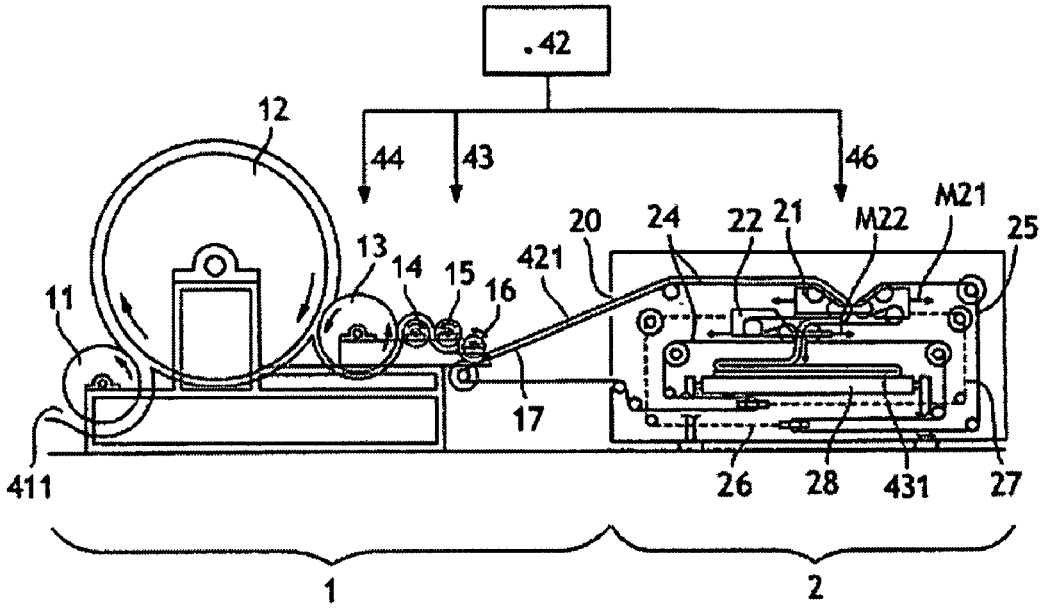

FIG. 4 illustrates an installation for the production of non-woven textiles comprising a carding machine 1, producing a web 421, feeding a crosslapper 2. The carding machine comprises a feed roll 11, collecting fibres 411 directly or indirectly from a stock pile to feed a carding cylinder 12. The circumference of the cylinder 12 is equipped with known means (not shown) to handle the fibres entrained by the cylinder. These fibres are removed from the cylinder 12 by a doffer roll 13, then transferred successively onto a first condenser roll 14 and a second condenser roll 15. The web 421 thus formed is detached by a stripping roll 16 rotating in the same direction as the last condenser roll and depositing the web on a conveyor belt 17 leading to the entrance 20 of the crosslapper 2. The fibres are orientated circumferentially on the doffer 13. In traditional machines, the condensers 14 and 15 are used to increase the surface weight of the web, reduce the speed of the web and give the fibres a more varied orientation than on the doffer. The condensation effect is obtained by giving the second condenser roll 15 a lower peripheral speed than that of the first condenser roll 14, whose peripheral speed is itself less than that of the doffer 13.

The crosslapper 2 comprises an entry belt or front belt 24 and a rear belt 25 each forming a closed loop. These loops are external to one another and run round several rollers rotating about fixed shafts as well as rollers carried by a buffer carriage 21 and others carried by a lapper carriage 22. Each of the two belts 24 and 25 is driven by one of the fixed-shaft rollers with which it is associated and which is coupled to a respective electric servo-motor.

At the entrance 20 of the crosslapper 2, the web 421 is conveyed to the buffer carriage 21 by the entry belt or front belt 24, of which one zone may constitute the conveyor belt 17, as shown. The web passes downwards through the buffer carriage 21, then the lapper carriage 22. The lapper carriage 22 is in reciprocating motion M22 in a direction perpendicular to the width of the web, and thus deposits the web 421 in successive segments on an exit apron 28 mobile in a direction parallel to the width of the web. The successive accumulated and offset segments formed by the web 421 deposited on the exit apron 28 form the lap 431 (FIG. 5) which is conveyed to the consolidation treatment 3 (FIG. 2). The buffer carriage 21 is in reciprocal motion M21 in the same direction as the lapper carriage 22 with a displacement law calculated to adjust the distance to be travelled by the web between the entrance 20 of the crosslapper and the lapper carriage 22. Said distance is more particularly adjusted to combine with each other the speed of entry of the web 421 into the crosslapper with the speed at which the web passes through the lapper carriage 22. The entry speed 20 is equal to the rate of production of the carding machine, as modified if necessary at each moment by the card doffer 13 which can operate at variable speed and by the variable condensation which will be described. The speed at which the web passes through the lapper carriage 22 is either equal to the travelling speed of the lapper carriage 22 if the web must be deposited without addition of a condensation or a stretching, or different if the web must be condensed or stretched while being deposited on the exit apron of the crosslapper.

In the first embodiment, the dynamic control according to the invention affects the preparation or the transport of the web 421, namely upstream of the depositing of the web on the exit apron 28 by the lapper carriage 22.

Figure 5:
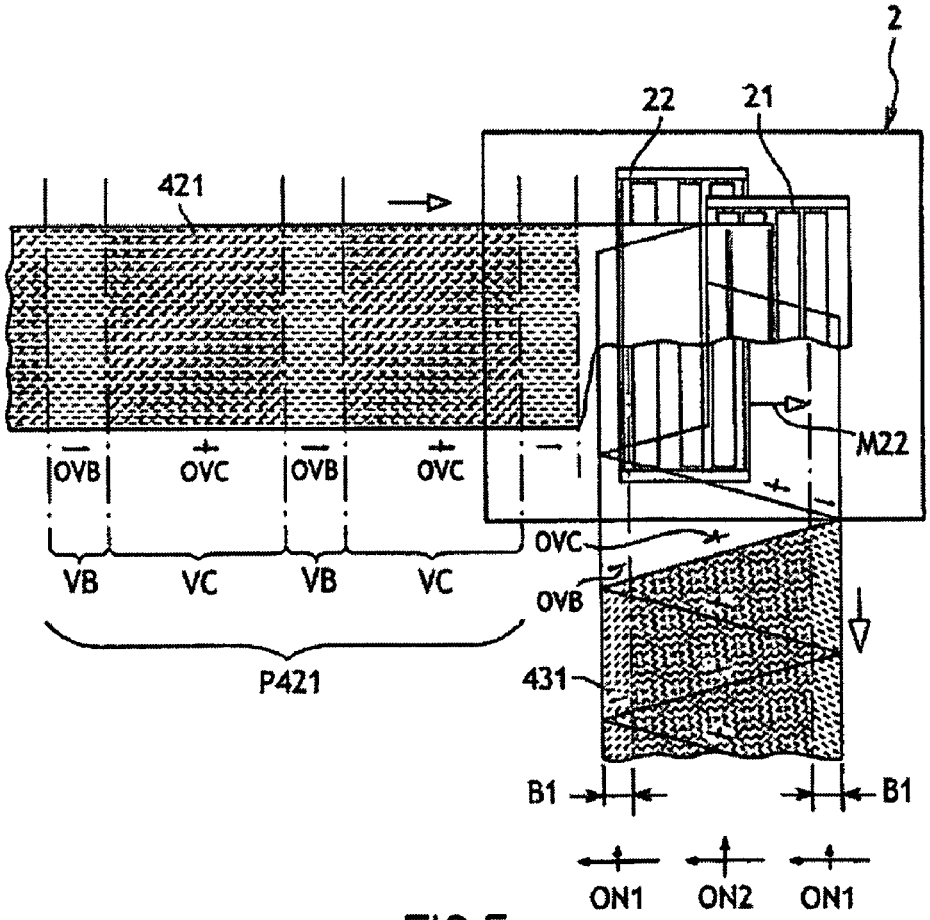
FIGS. 4 to 6 illustrate the invention in its first embodiment, in particular.

In the embodiment illustrated in FIG. 5, this adjustment modification produces in the web 421 entering the crosslapper 2 an alternating structure having, along the longitudinal direction of the web 421, alternating zones VC and VB which differ in their fibre orientation distributions.

The zones VB are intended to form the edge zones B1 of the lap 431, while the zones VC are intended to form its central part. In the zones VB corresponding to the edges of the lap, the fibres of the web have a particular orientation spectrum OVB, whereas in the zones VC corresponding to the centre of the lap the fibres of the web have a different orientation spectrum OVC.

When it is sought to increase the MD/CD ratio of the central zone of the lap 431, the dynamic control is carried out so as to increase the transverse component of the orientation spectrum OVC of the zones VC of the web 421. These zones VC then produce a central zone in the lap where the fibres have an orientation spectrum ON2 (FIG. 2) having a greater longitudinal component FM2. After consolidation, this same central zone has an increased MD/CD ratio. As, for its part, the MD/CD ratio of the edge zones of the consolidated lap has been increased by the needle-punching effect described with reference to FIG. 1*c*, the two MD/CD ratios may be made equal.

In a similar way to that just described for the uniformization of the MD/CD ratio in the consolidated lap, the method according to the invention may be used to produce other types of distribution profile of the spectra of orientation of the fibres within the width of the lap such as 431. The invention therefore makes it possible to produce a non-woven textile which after consolidation displays mechanical strength values distributed according to a chosen profile, preferably taking account of the variations directly induced by the consolidation in the edge zones, as shown in FIG. 1*c*.

Such chosen profiles may for example enable a textile to be produced which will tear more easily along a chosen longitudinal zone, for example to facilitate separation or cutting in such a zone.

In certain cases of fibre orientation profile in the lap 431, such as the one shown in FIG. 5 which is symmetrical relative to the longitudinal axis of the lap 431, the frequency of variation of the adjustments exerting an influence on the orientation of fibres corresponds to half an operating period of the crosslapper 2, corresponding to a sequence of a zone VC and a zone VB on the web 421. In the general case, such as that of a non-symmetrical profile, the period of adjustment variation corresponds to a whole operating period of the crosslapper.

Figure 6:
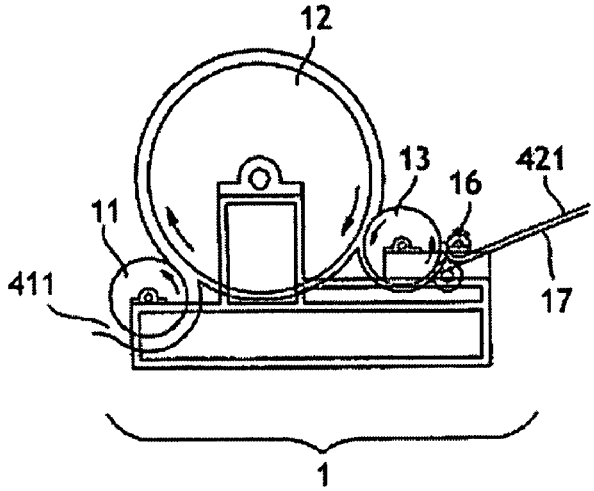

In the embodiment shown in FIGS. 4 to 6, influence is exerted on the orientation of the fibres in the web 421 by carrying out a condensation in the VC parts of the web.

Certain combinations of zones and adjustments give particularly useful results in the field of fibre orientation and in the distribution of mechanical strengths and elongations after consolidation.

Tests have shown that the re-orientation of fibres by condensation of the web, in particular upstream of the lapper carriage or in the carding machine, had a spectacular effect on the anisotropy of the mechanical strength in the final non-woven textile, compared with the chosen degree of condensation.

For example, a condensation of the order of 17% in terms of surface weight can vary the value of MD/CD in the consolidated lap by approximately 40% in the case of a geotextile based on polypropylene fibres.

Preferably, the variable condensation is carried out within the carding machine during the production or the transportation of the web, by varying the speeds of at least two rotating devices of the carding machine or conveying system relative to one another. One of these devices rotates for example at a given speed, and one or more following devices rotate at a lower speed when the condensation must be effective.

For example, if the doffer roll 13 is rotating at a circumferential speed of 130 m/mn while the stripping roll 16 is rotating at 100 m/mn, the web produced will have a 30% condensation. This condensation will be able, for example, to be carried out in several intermediate phases, with the first condenser roll 14 rotating at 80 m/mn and the second condenser roll 15 rotating at 50 m/mn.

In another configuration, not shown, the carding machine may comprise a single condenser roll. Such a 30% condensation will then be able to be obtained with a doffer roll rotating at 130 m/mn, the condenser roll rotating at 80 m/mn, and the stripper rotating at 100 m/mn.

In another configuration shown in FIG. 6, a doffer roll 13 is directly followed by a stripper 16. Such a 30% condensation may then be directly carried out between the doffer rotating at 130 m/mn and the stripper rotating at 100 m/mn.

Alternatively to or in combination with dynamic control of the condensation in the carding machine 1, a condensation may also be dynamically controlled along the transportation path or within the crosslapper 2.

The transportation path may thus comprise one or more condensation devices. These may, for example, be one or more condenser rolls whose circumferential speed is dynamically controlled. A dynamically-controllable condensation may be carried out using a stretching or compression device such as described in WO 02/101130 A1 or FR-A3-2 828 696 positioned between the carding A machine proper and the crosslapper proper. These devices may, for example, according to the invention, operate with variable stretching to cancel out at least in part, and in a variable manner, a constant condensation at the exit of the carding machine. Thus, an adjustment of surface weight and adjustment of the orientation spectrum are carried out at the same time, since the zones along the web experiencing the greatest stretching, intended to be positioned close to the edges of the lap, are both made lighter (reduced surface weight) and simultaneously 'longitudinalized' with regard to the orientation of the fibres, while the other, less stretched, zones keep the higher surface weight and the more homogeneous orientation spectrum which result from the condensation at the exit from the carding machine.

A dynamic control of condensation of the web may also be carried out in the crosslapper 2, for example by modifying the law of displacement of one or two of its carriages 21 and 22 so as to adjust the speed at which the web crosses the lapper carriage 22 relative to the travelling speed of the lapper carriage 22. Instead of adjusting the condensation for each point of the stroke of the lapper carriage, and hence for each point of the width of the lap, adjustments may be made by zone, for example the two edge zones and the central zone.

A second embodiment, which will be described with reference to FIGS. 7 and 8, may be used as an alternative to the first embodiment, or in combination therewith.

In this second embodiment, a dynamic control is performed affecting the preparation or the transportation of the lap 432, in other words at the stage, or downstream, of the deposition of the web 422 on the exit apron 28 in the crosslapper 2.

Figure 7:
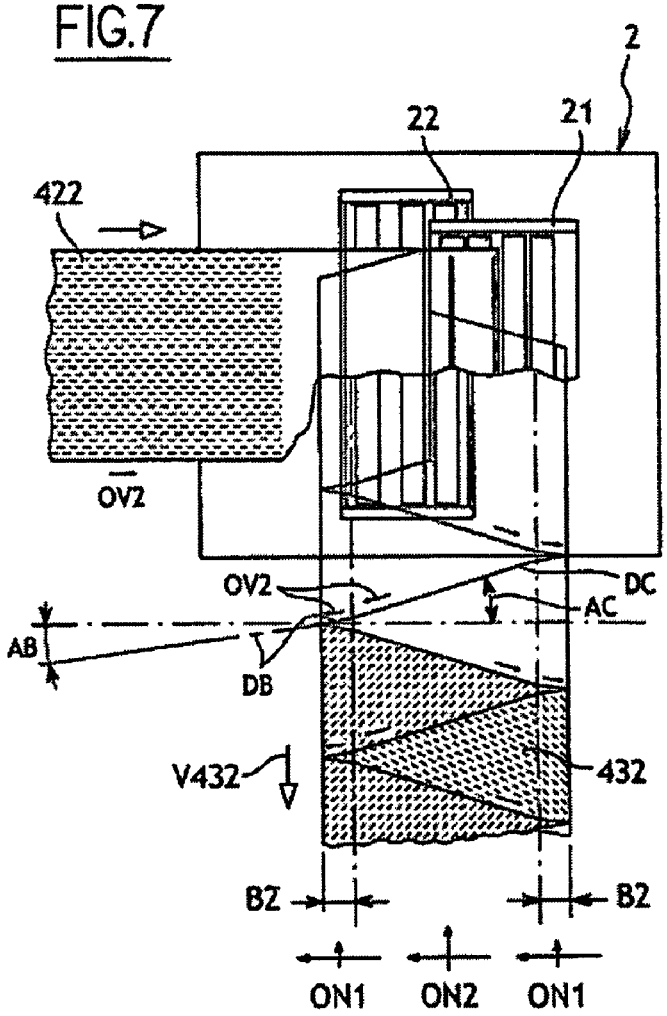
FIG. 7 is a top view of the crosslapper (partially exploded) and of its entrances and exits, in an example implementing the second embodiment of the invention.
Figure 8:
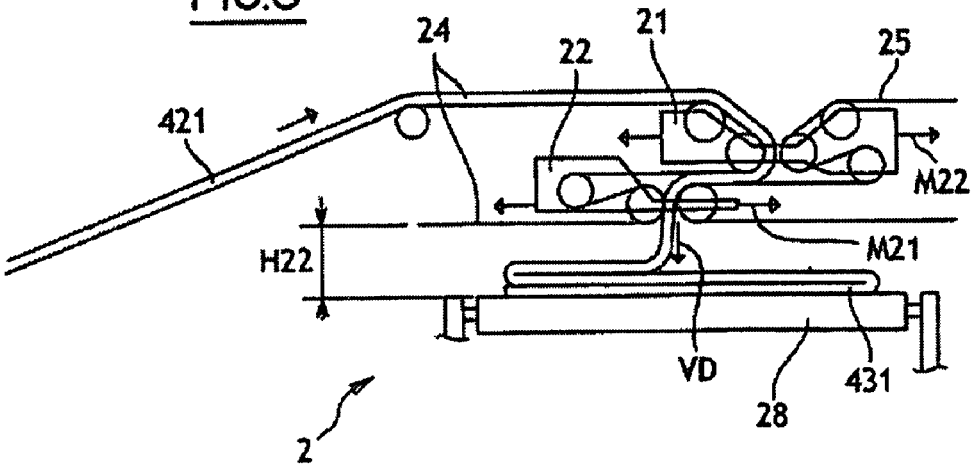
FIG. 8 is a side view of the crosslapper carriages, illustrating certain variants of the second embodiment of the invention.

As illustrated in FIG. 7, this adjustment modification produces a modification to the deposition scheme of the lap 432, to form each of the transverse segments composing the lap 432, modifying the inclination of the segment relative to the width of the lap. Within the lap 432, the longitudinal direction DB or DC of each segment forms an angle AB or AC respectively with the width of the lap.

In certain traditional crosslappers, the exit apron, such as 28, advances at a constant speed. The relationship between this constant speed and the travelling speed of the lapper carriage such as 22 defines the angle between the width of the lap and the longitudinal direction of the web segments.

It is known to slow down the exit apron when the lapper carriage slows down close to its reversal of operation points, in order to keep constant the relationship between the speed of the exit apron and the speed of the lapper carriage. Thus the angle formed by a segment with the width of the lap is constant from one edge of the lap to the other according to the state of the art.

With the present invention, the exit apron is slowed still further, such that the angle AB in the edge zones B2 is less than the angle AC in the central zone of the lap, as shown in FIG. 7.

Starting from a dominant orientation OV2 of the fibres in the web 422, the variation of the direction of deposition of the web on the exit apron thus produces a desired variation in the orientations of the fibres along the width of the lap.

Thus, due to the dynamic control of the direction of deposition of the web so as to increase the deposition angle AC in the central zone, relative to the deposition angle AB in the edge zones B2, the orientation spectrum ON2 at the centre of the lap is less elongated in the widthwise direction of the lap than the orientation spectrum ON1 in the edge zones. After consolidation, the edge zones exhibit an MD/CD ratio close to that of the central zone.

In the same way as indicated for the first embodiment, this second embodiment may also be used to obtain a chosen non-uniform profile with regard to the distribution of the strength values within the textile produced, and not simply a uniform profile.

The installation according to the invention preferably combines the means described so far aimed at controlling the distributions of orientations of the fibres across the width of the lap, with means such as according to EP-1 036 227 to control the profile of the surface weights over the width of the lap.

For this, once the adjustments intended to provide the desired distribution of orientations spectra over the width of the lap and/or the desired distribution over the width of the lap, of variables, such as the MD/CD ratio, relating to the mechanical strength of the lap have been carried out, a second dynamic control having substantially no effect on the orientation of the fibres is performed affecting the surface weight of the lap. The second adjustment may be an adjustment varying the quantity of fibres removed by the doffer from the carding cylinder. More specifically, the second adjustment may, for example, involve varying the speed of rotation of the doffer (the quicker the card doffer rotates the fewer fibres it collects with each revolution, and the lighter the web it produces) or the distance between the doffer and the carding cylinder (the further the doffer is from the cylinder, the fewer fibres it collects with each revolution, and the lighter the web it produces).

In a specific example, the speed of the carding doffer is dynamically controlled to produce a web whose weight is not uniform along its longitudinal direction, such as described for example in EP-A-1036 227, and the distribution of orientation of the fibres in the web is adjusted by dynamically varying the degree of condensation of this web, in other words, for example, the relationship between the speed of a stripping roll and the speed of the doffer. Consequently, if at a given moment the speed of the carding doffer varies and the degree of condensation must remain constant, the speed of the stripping roll must typically be varied in the same proportion as the speed of the doffer.

In this embodiment, wherein the control of fibre orientation is produced by a means, here condensing means, which also varies the surface weight of the web, the surface weight variations induced by the control of orientation must be taken into account by the weight control means, here the doffer. For example if the doffer begins to collect fibres for a web portion which should keep a constant weight but will be made heavier by the orientation means, the doffer will collect less fibres to compensate for the future weight increase induced by the orientation means.

Preferably, the dynamic control affecting the orientation of the fibres in the lap includes a control loop. In a preferred version, this adjustment is combined with control of the surface weight profile such as according to WO A 00/73547 or EP 1 057 906 B1.

For this, as shown in FIG. 2, a transverse detector 41 of the type described in WO A 00/73547, comprising a series of sensors aligned parallel to the width of the lap, or, by way of a variant, a single sensor called a "travelling" sensor which moves back and forth above the lap is placed above the lap leaving the needle loom 3. The transverse detector 41 detects the width of the consolidated lap 440 and the surface weight at various points of the width of the lap. The detection of the width of the lap allows a computer 42 to calculate the lateral shrinkage dc experienced by the lap during the consolidation, either using the difference with a width detection (not shown) upstream of the needle loom 3, or from the difference with the travel length of the lapper carriage of the crosslapper 2. This travel length is known by the computer 42 since the lapper carriage is precisely actuated by a servomotor (not shown) also controlled by this computer.

The width of the edge zone of the lap which is altered in conjunction with the shrinkage phenomenon dc is known from experience or from previous tests. Simple arithmetical calculation and/or previous tests enable the impact of this shrinkage on the distribution of orientation of the fibres in the edge zone affected by shrinkage to be calculated. According to this evaluation, the computer 42 orders an adjustment of the orientation means.

For example, according to said calculation, the computer 42 calculates a degree of condensation which must be applied to the parts of the web intended to form the central zone of the lap, in order that this central zone exhibits, in the consolidated lap, a distribution of orientation or, at any rate, a bidirectional orientation spectrum, which is substantially equal to that of the edge zones. Simultaneously or temporally alternating with this adjustment of the distribution of orientations, the computer 42 receives from the detector 41 surface weight measurements from various points across the width of the consolidated lap 440 and adjusts the surface weight profile of the consolidated lap and the width of the consolidated lap, as is described in WO A 00/73547, exerting an influence on the parameters such as those described above (doffer speed, distance between the doffer and the card cylinder), which do not, or practically do not affect the orientation of the fibres in the web. FIG. 4 illustrates in diagrammatic form the computer 42 sending instructions 43 to the condensers, 14, 15 and to the stripper roll 16 for the dynamic control of condensation, instructions 44 to the carding doffer 13 for the dynamic control for the weight without affecting the orientation of the fibres, and instructions 46 to the crosslapper 2 to adjust and define at every moment the position of the two carriages 21, 22 in their reciprocating movements M21, M22 and the speed of travel of the belts 24, 25. Lines 43, 44, 46 are bidirectional in order to transmit back to the computer 42, information about the actual values of the operating parameters of the carding machine and of the crosslapper in particular.

In another embodiment of the control means, it is considered to use at the outlet of the needle loom 3, in addition to the detector 41, at least one image sensor (not shown) in one of the edge zones, and preferably at least three image sensors for the two edge zones and the central zone respectively. The images produced by these sensors are analysed to determine the distribution of orientation of the fibres in the images obtained. The computer 42 then calculates, for example, the bidirectional spectra of orientation corresponding to the distributions observed and controls the orientation means in a direction tending to equalize or keep equal these bidirectional spectra.

The invention is not limited to the examples described and shown.

In particular, the control based on a detection of transverse shrinkage of the lap, could be carried out without being combined with an adjustment of the surface weight profile.

The orientation means implemented within the framework of a control loop for automatically adjusting the distributions or spectra of orientation may be any of those described, for example the drive motor of the exit apron of the crosslapper 2 as described with reference to FIG. 7.

Nor is the invention limited to the use of determined mathematical parameters such as the distributions of orientation or the bidirectional spectra of orientation defined above.

The invention claimed is:

1. A method for the production of a non-woven textile comprising fibres, with the following steps:

producing a non-woven strip; and subjecting said strip to a consolidation step differently affecting a distribution of orientations of the fibres depending on a position of the fibres along the width of the strip;

wherein, by a dynamic control, influence is exerted in a targeted manner on the distribution of orientations of the fibres according to the position of said fibres in the width direction of the strip prior to the consolidation step;

whereby different distributions of orientation are established at different points of the width of the strip before consolidation in such a targeted manner that the non-woven textile obtained after the consolidation step exhibits a substantially uniform MD/CD ratio over the width of the textile, said MD/CD ratio being the ratio of one of mechanical strengths and elongations in the longitudinal direction and in the width direction, respectively.

2. The method according to claim 1, wherein in a bidirectional spectrum of the orientations of the fibres before consolidation, said spectrum having a transverse component parallel to the width of the strip and a longitudinal component parallel to the length of the strip, said transverse component is greater, compared with the longitudinal component, in two edge regions of the strip than in a central region of the strip.

3. The method according to claim 1, in which a carding machine provides at least one web which is superimposed in successive substantially transversal segments which overlap one another in order to form in a crosslapper a lap forming said non-woven textile-strip which subsequently undergoes said consolidation step, wherein said dynamic control exerts an influence on the orientation of the fibres in successive regions of the length of the web.

4. The method according to claim 3, wherein said dynamic control exerts an influence on a degree of condensation of the web.

5. The method according to claim 4, wherein the dynamic control exerting an influence on the condensation is at least in part an adjustment of the relative speeds, in relation to each other, of at least two rotating devices of the carding machine contributing to the manufacture or the transportation of the web.

6. The method according to claim 5, wherein said relative speeds are those of a stripping roll and respectively a doffer of the carding machine.

7. The method according to claim 5, wherein said relative speeds are those of a condenser and respectively another condenser or a doffer of the carding machine.

8. The method according to claim 5, wherein said relative speeds are those of a stripping roll and respectively, a condenser of the carding machine.

9. The method according to claim 1, wherein the consolidation step is selected from needle- punching, bonding by water jet, thermal bonding, and chemical bonding.

10. The method according to claim 1, wherein the dynamic control forms part of a control loop also comprising means of measuring at least one physical variable relating to the strip, and control means for modifying dynamic control in relation to the measured physical variable.

11. The method according to claim 10, wherein the measured physical variable is a shrinkage experienced by the strip along the width direction during the consolidation step.

12. The method according to claim 10, wherein a double adjustment is carried out, said adjustment exerting an influence on the distributions of orientations of the fibres, and an adjustment of the surface weight of the strip at different points of its width by exerting an influence on a second dynamic control which is substantially without effect on the orientation of the fibres.

13. The method according to claim 1, wherein influence is exerted on the surface weight of the strip at different points of its width by a second dynamic control means which is substantially without effect on the orientation of the fibres.

14. The method according to claim 12, wherein the second dynamic control affects the quantity of fibres collected by a carding machine doffer.

15. The method according to claim 1, wherein said consolidation step is a needle-punching step.

16. A method according to claim 3, characterized in that dynamic control affects the displacement of at least one carriage of the crosslapper in a direction substantially transversal to the lap.

17. A method according to claim 16, characterized in that the dynamic control exerts an influence on the relationship between a speed at which the lap exits the crosslapper and the speed at which a point of deposition of the web on the lap being formed within the crosslapper moves along the width of the lap.

18. A method according to claim 3, characterized in that at least one dynamic control exerts an influence on a run-off speed of an exit apron of the crosslapper fed with a web of fibres having an anisotropic distribution of orientations.

19. A method for the production of a non-woven textile comprising:

producing a non-woven strip comprising fibres, the non-woven strip defining a width direction (CD) and a longitudinal direction (MD);

subjecting the non-woven strip to a consolidation step that differently affects a distribution of orientations of the fibres depending on a position of the fibres along the CD of the non-woven strip; and exerting influence by a dynamic control in a targeted manner on the distribution of orientations of the fibres according to the position of the fibres in the CD of the non-woven strip prior to the consolidation step;

wherein different distributions of orientation are established at different points of the CD of the non-woven strip before the consolidation step in such a targeted manner that the non-woven textile obtained after the consolidation step exhibits a substantially uniform MD/CD strength ratio over the width of the textile, said MD/CD strength ratio being the ratio of mechanical strengths in the MD and in the CD, respectively.

20. The method according to claim 19, wherein in a bidirectional spectrum of the orientations of the fibres before consolidation, the spectrum having a transverse component in the CD of the strip and a longitudinal component in the MD of the strip, said transverse component is greater, compared with the longitudinal component, in two edge regions of the non-woven strip than in a central region of the non-woven strip.

21. The method according to claim 19, in which a carding machine provides at least one web which is superimposed in successive substantially transversal segments which overlap one another in order to form in a crosslapper a lap forming said non-woven textile-strip which subsequently undergoes said consolidation step, wherein said dynamic control exerts an influence on the orientation of the fibres in successive regions of the length of the web.

22. The method according to claim 21, wherein said dynamic control exerts an influence on a degree of condensation of the web.

23. The method according to claim 22, wherein the dynamic control exerting an influence on the condensation is at least in part an adjustment of the relative speeds, in relation to each other, of at least two rotating devices of the carding machine contributing to the manufacture or the transportation of the web.

24. The method according to claim 23, wherein said relative speeds are those of a stripping roll and respectively a doffer of the carding machine.

25. The method according to claim 23, wherein said relative speeds are those of a condenser and respectively another condenser or a doffer of the carding machine.

26. The method according to claim 23, wherein said relative speeds are those of a stripping roll and respectively, a condenser of the carding machine.

27. The method according to claim 19, wherein the consolidation step is selected from needle-punching, bonding by water jet, thermal bonding, and chemical bonding.

28. The method according to claim 19, wherein the dynamic control forms part of a control loop also comprising means of measuring at least one physical variable relating to the non-woven strip, and control means for modifying dynamic control in relation to the measured physical variable.

29. The method according to claim 28, wherein the measured physical variable is a shrinkage experienced by the strip along the CD during the consolidation step.

30. The method according to claim 28, wherein a double adjustment is carried out, said adjustment exerting an influence on the distributions of orientations of the fibres, and an adjustment of the surface weight of the non-woven strip at different points along the CD by exerting an influence on a second dynamic control which is substantially without effect on the orientation of the fibres.

31. The method according to claim 19, wherein influence is exerted on the surface weight of the non-woven strip at different points along the CD by a second dynamic control means which is substantially without effect on the orientation of the fibres.

* * * * *